US008590280B2

(12) United States Patent
Passoni

(10) Patent No.: US 8,590,280 B2
(45) Date of Patent: Nov. 26, 2013

(54) METHOD AND APPARATUS FOR INSERTING OBJECTS INTO OPENED ENVELOPES

(75) Inventor: Gianfranco Passoni, Châtillon (CH)

(73) Assignee: Bowe Systec GmbH, Augsburg (DE)

( * ) Notice: Subject to any disclaimer, the term of this patent is extended or adjusted under 35 U.S.C. 154(b) by 1496 days.

(21) Appl. No.: 11/664,394

(22) PCT Filed: Sep. 29, 2005

(86) PCT No.: PCT/CH2005/000563

§ 371 (c)(1),
(2), (4) Date: Oct. 4, 2007

(87) PCT Pub. No.: WO2006/037245

PCT Pub. Date: Apr. 13, 2006

(65) Prior Publication Data

US 2009/0000254 A1 Jan. 1, 2009

(30) Foreign Application Priority Data

Oct. 1, 2004 (FR) ..... 04 10380

(51) Int. Cl.
*B43M 3/00* (2006.01)
*B65H 3/26* (2006.01)

(52) U.S. Cl.
USPC ..... 53/460; 53/473; 53/492; 53/569; 53/250; 53/381.7; 270/58.06; 271/2

(58) Field of Classification Search
CPC ..... B43M 3/00; B43M 3/045; B43M 3/04; B65H 3/26
USPC ..... 53/457, 460, 564, 249, 250, 284.3, 53/381.3, 381.6, 381.7, 473, 492, 569, 53/381.5; 271/109, 112, 132, 2; 270/58.06
IPC ..... B43M 3/00,3/04
See application file for complete search history.

(56) References Cited

U.S. PATENT DOCUMENTS 2,668,053 A * 2/1954 Bach ..... 493/420
3,253,384 A * 5/1966 Huck et al. ..... 53/53

(Continued)

FOREIGN PATENT DOCUMENTS

EP 1 332 891 8/2003
JP 05-004620 1/1993

(Continued)

OTHER PUBLICATIONS

"Notification of Reasons for Refusal", mail dated Apr. 12, 2011. (Office Action Issued for Coresponding JP Application—English Translation included), JP 2007-533848, 5 pages.

*Primary Examiner* — Stephen F Gerrity
(74) *Attorney, Agent, or Firm* — Davis & Bujold, PLLC; Michael J. Bujold

(57) ABSTRACT

A method and apparatus for inserting an object into an envelope in which the envelopes are stacked in a stacker. An envelope flap of the envelope is grasped by a lip on a rotary cam to open the envelope. The envelope flap of the envelope is brought into and maintained in contact with a surface of the rotary cam. The envelope is then pulled, via the envelope flap, so as to place and maintain the envelope in contact with the surface of the rotary cam. The rotary cam reverses the envelope to move the envelope into an inserting area where the envelope is detached from the surface of the rotary cam. An object is then inserted into the envelope and the envelope is then removed from the inserting area.

12 Claims, 8 Drawing Sheets

(56) References Cited

U.S. PATENT DOCUMENTS

| | | | | | |
|---|---|---|---|---|---|
| 3,568,401 | A | * | 3/1971 | Bonsch | 53/569 |
| 3,593,486 | A | * | 7/1971 | Helm | 53/460 |
| 3,962,848 | A | * | 6/1976 | Hankins | 53/284.3 |
| 4,262,471 | A | * | 4/1981 | Russell | 53/381.6 |
| 4,285,509 | A | * | 8/1981 | Reid | 271/1 |
| 4,364,217 | A | * | 12/1982 | Torrenteras et al. | 53/58 |
| 4,373,848 | A | * | 2/1983 | Bishop | 414/403 |
| 4,450,037 | A | * | 5/1984 | Gavronsky | 156/441.5 |
| 4,674,258 | A | * | 6/1987 | Ehlscheid et al. | 53/154 |
| 4,715,164 | A | * | 12/1987 | Luperti et al. | 53/381.7 |
| 4,813,209 | A | * | 3/1989 | Foster et al. | 53/381.7 |
| 4,926,612 | A | * | 5/1990 | Krasuski et al. | 53/69 |
| 5,052,168 | A | * | 10/1991 | DeWitt et al. | 53/492 |
| 5,251,425 | A | * | 10/1993 | Kern | 53/460 |
| 5,255,498 | A | * | 10/1993 | Hotchkiss et al. | 53/569 |
| 5,414,977 | A | * | 5/1995 | Cohen | 53/460 |
| 5,421,700 | A | * | 6/1995 | Kranz | 414/798.5 |
| 5,447,015 | A | * | 9/1995 | Belec et al. | 53/492 |
| 5,651,238 | A | * | 7/1997 | Belec et al. | 53/504 |
| 5,660,030 | A | * | 8/1997 | Auerbach et al. | 53/569 |
| 5,737,899 | A | * | 4/1998 | Supron et al. | 53/155 |
| 5,809,749 | A | * | 9/1998 | Ruggiero et al. | 53/473 |
| 5,911,668 | A | * | 6/1999 | Auerbach et al. | 53/569 |
| 6,224,050 | B1 | * | 5/2001 | Wicki | 271/37 |
| 6,240,710 | B1 | * | 6/2001 | Button et al. | 53/473 |
| 6,530,192 | B2 | * | 3/2003 | Buckley et al. | 53/381.7 |
| 6,536,184 | B1 | * | 3/2003 | Sting et al. | 53/284.3 |
| 6,973,762 | B2 | * | 12/2005 | Miller et al. | 53/381.6 |
| 7,155,878 | B2 | * | 1/2007 | Stemmle et al. | 53/381.5 |
| 7,188,460 | B2 | * | 3/2007 | Rozenfeld | 53/381.6 |
| 7,401,448 | B2 | * | 7/2008 | Sytema et al. | 53/381.7 |
| 7,437,862 | B2 | * | 10/2008 | van der Werff | 53/569 |

FOREIGN PATENT DOCUMENTS

| | | |
|---|---|---|
| JP | 06-122417 | 5/1994 |
| WO | WO 02/087973 | 11/2002 |

* cited by examiner

METHOD AND APPARATUS FOR INSERTING OBJECTS INTO OPENED ENVELOPES

This is a national stage completion of PCT/CH2005/000563 filed Sep. 29, 2005 which claims priority from French Application Serial No. 0410380 filed Oct. 1, 2004.

TECHNICAL DOMAIN

The present invention concerns a process for the automatic stuffing of objects to be inserted into envelopes stacked in a pile and provided with a closing flap arranged on the lower face, with these envelopes facing the front for the purpose of uptake.

It also concerns a device for the automatic stuffing of objects, consisting of

- a means for the stacking of envelopes in a pile
- a means for conveying the envelopes, and
- a means for bringing the objects to the envelopes, and for inserting them in the envelopes.

PRIOR ART

Devices of this type are already known for the stuffing of letters and/or attachments for the purpose of their distribution by mail on a large scale. In general, these devices are of a complicated construction and include a large number of moving mechanical components to guide and lead the envelopes on the one hand, and letters with attachments on the other, to a location for merging the two components to be dispatched, referred to as the stuffing zone. Given that the pathways of the envelopes and the mail, as well as the attachments, are separate, but that the stuffing zone is common, in the known devices, the envelopes are fed on a path which is opposite that of the documents to be stuffed, before being withdrawn from the device. The envelopes usually arrive in a position such that their windows are facing upward. The documents to be inserted consist of, on the one hand, a letter or any other mail on which the address of the addressee is indicated, and on the other hand, the attachments. These must of necessity arrive at the stuffing zone in such a way that the mail is on the top of the pile, and the attachments on the bottom. This positioning involves a reversal phase of the group consisting of at least one letter and its attachments. In fact, the letter is drawn in first, and then attachments from stacks located above the letter feed pathway are deposited successively and selectively over this letter. As a consequence, in order for the address to remain visible and to appear in the envelope window, the letter must be inserted first, with its address on the bottom, and the attachments must be inserted on the back of the letter so as in order not to conceal the address. Since the envelope window faces downward, the group consisting of the letter and its attachments must necessarily be reversed.

The reversal units have a complicated construction, and their functioning is relatively slow, which causes a significant reduction in stuffing speed. In fact, in this system, each cycle must be fully completed before the following cycle is initiated, that is, an envelope must be stuffed with the documents assigned to it and evacuated from the stuffing zone before the next envelope can be led into the same location to receive documents. The speed is thus limited as a function of the slowest module on the line. Now the reversal module can without a doubt be considered a retarding component. At the present time, methods are being sought to improve the performance of these stuffing lines by improving the performance of the modules which comprise them, and above all by simplifying their construction, which is very complicated, costly, and which impedes the desired speed of operation.

In particular, U.S. Pat. No. 3,253,384 is known, which concerns a document stuffing machine essentially capable of folding documents before stuffing them into envelopes. This machine has a relatively slow speed in the order of 4,000 to 6,000 envelopes per hour. Current speeds actually exceed 20,000 envelopes per hour with the folding of the attachment documents is accomplished on separate units, which are located in parallel with the stuffing module.

PRESENTATION OF THE INVENTION

The objective of the present invention is to overcome the problems associated with existing devices by offering a simple and effective device with an economical construction, for which maintenance is easy, and which allows automatic stuffing at very high speeds.

This objective is attained by a process in which closing flap of an envelope is maneuvered by means of a lip on a rotary cam to open the envelope; the closing flap of the envelope is then brought into contact with a surface of the rotary cam, and the flap is maintained in contact with this surface; the envelope is then pulled by the closing flap; the envelope is next put in contact with the surface of the rotary cam, and it is maintained in contact with this surface; and the envelope is then drawn into the stuffing area.

The operations executed by the rotary cam for grasping and reversing the envelope include, the envelope is opened and that the closing flap as well as the envelope is detached from the surface of the rotary cam; and an object is inserted into the envelope before the stuffed envelope is withdrawn from the device.

In an advantageous manner, the closing flaps and the backwalls of the envelopes are pressed against the surface of the uptake and reversal rotary cam by vacuum pressure directed from the interior of this cam.

Preferably, the uptake and reversal rotary cam is detached from the closing flaps of the envelopes by means of a positioning guide placed on the path of these envelopes.

In a preferential manner, the uptake and reversal rotary cam is detached from the back walls of the envelopes by means of a scraper that is tangential in relation to the surface of this cam.

Advantageously, the opening of the envelope pockets is achieved by means of the envelope positioning guide.

The device for the implementation of this automatic stuffing process is characterized in that the means for conveying the envelopes consists of a cam for grasping and reversing the envelopes.

This cam has a lip designed to grasp the closing flap of an envelope and to open it.

This cam is designed to maintain the envelope closing flap against a surface of the cam, and to pull the envelope out of the pile by the closing flap.

This cam is designed to press the envelope against the surface of the cam, to bring the envelope to the object insertion area.

According to a preferred embodiment, the surface of the envelope uptake and reversal rotary cam has at least one peripheral surface perforated with openings which communicate with a vacuum.

The peripheral surface perforated with openings, advantageously, has a support protuberance for the closing flaps, and a support area for the back walls of the envelope pockets. The radius of the support protuberance is greater than that of the back wall support area.

According to the preferred embodiment, the device has a positioning guide, placed in the path of the envelopes, designed to lift the envelope closing flaps and open their pockets.

In a similar manner, the device has a scraper, tangential with respect to the surface of the uptake and reversal rotary cam, designed to detach the back walls of the envelopes.

SUMMARY DESCRIPTION OF THE DRAWINGS

The present invention and its advantages will become more apparent from the description of a non-limiting example of the preferred embodiment with reference to the attached drawings, in which.

METHOD OF REALIZING THE INVENTION

Figure 1A:
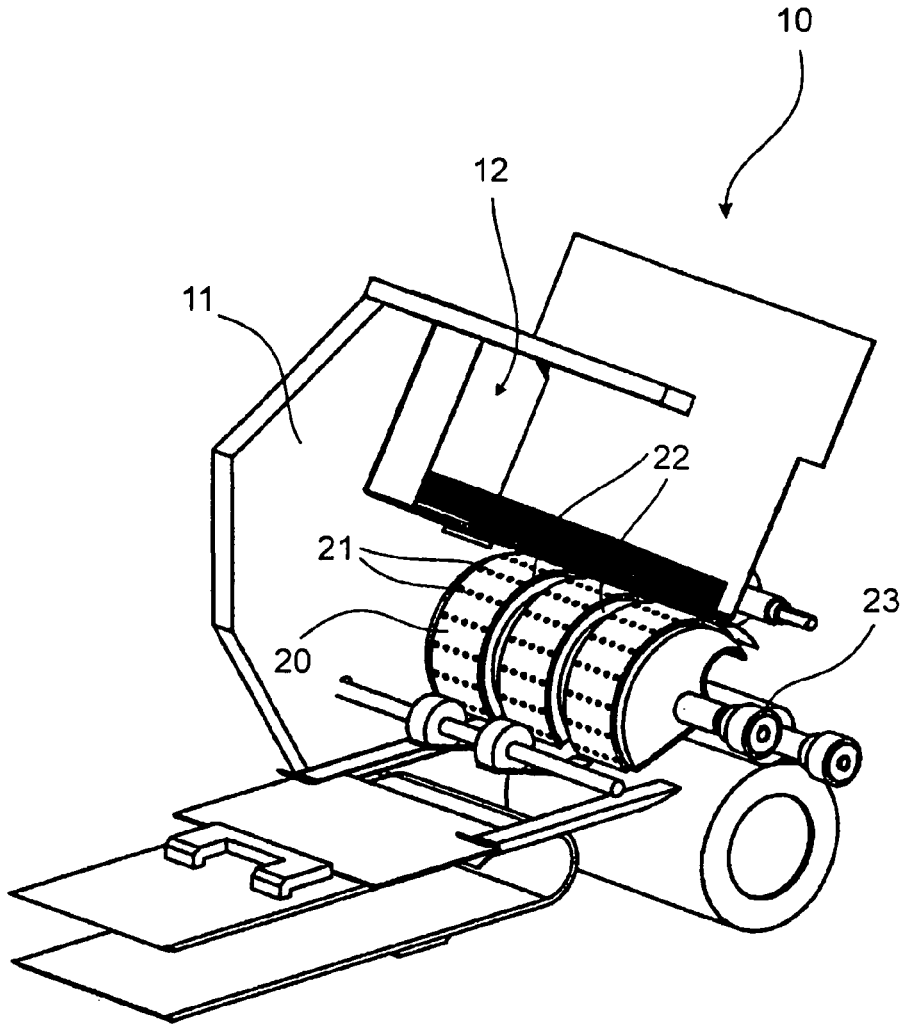
FIG. 1A is a partial perspective view representing the main constituent elements of a preferred form of the device according to the invention.
Figure 1B:
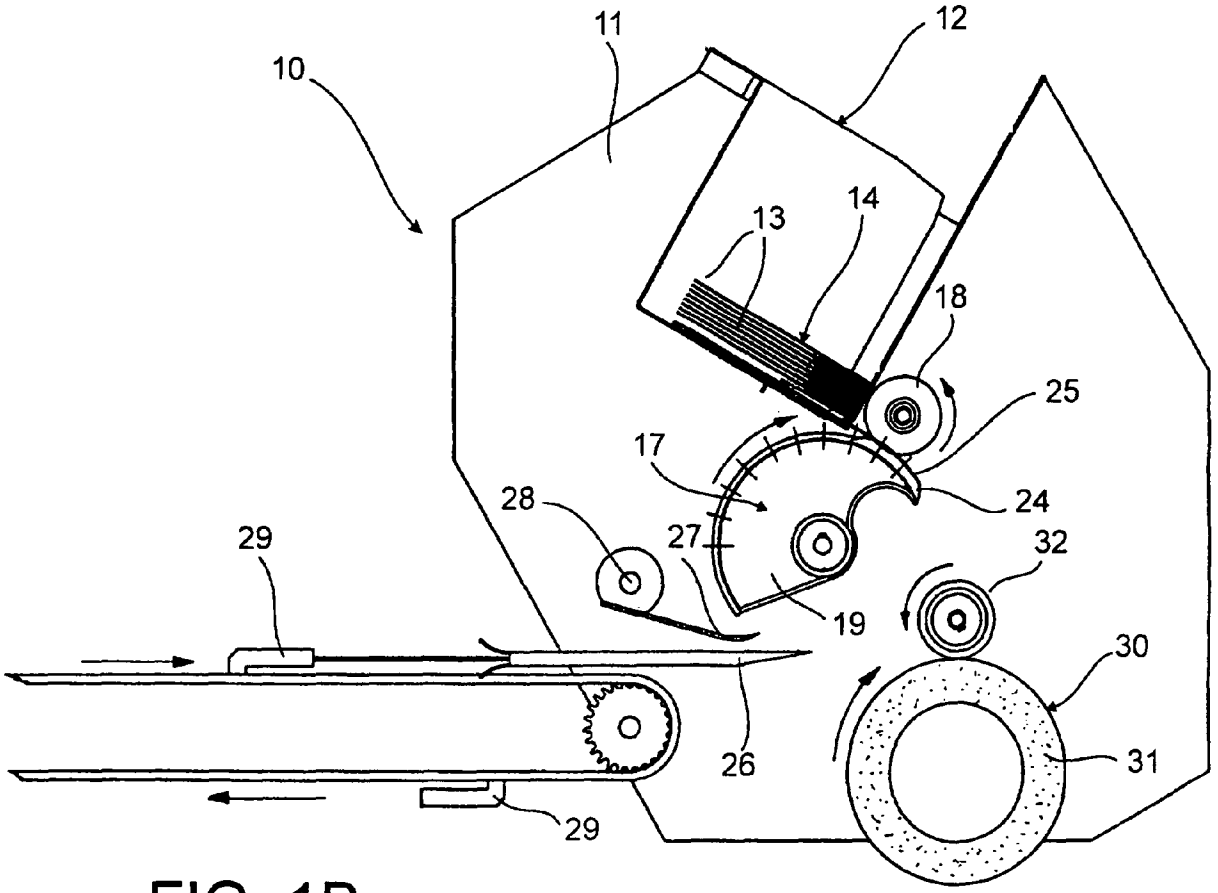
FIG. 1B is a side elevation view of the device according to FIG. 1A, in an established phase of its operation.
Figure 2A:
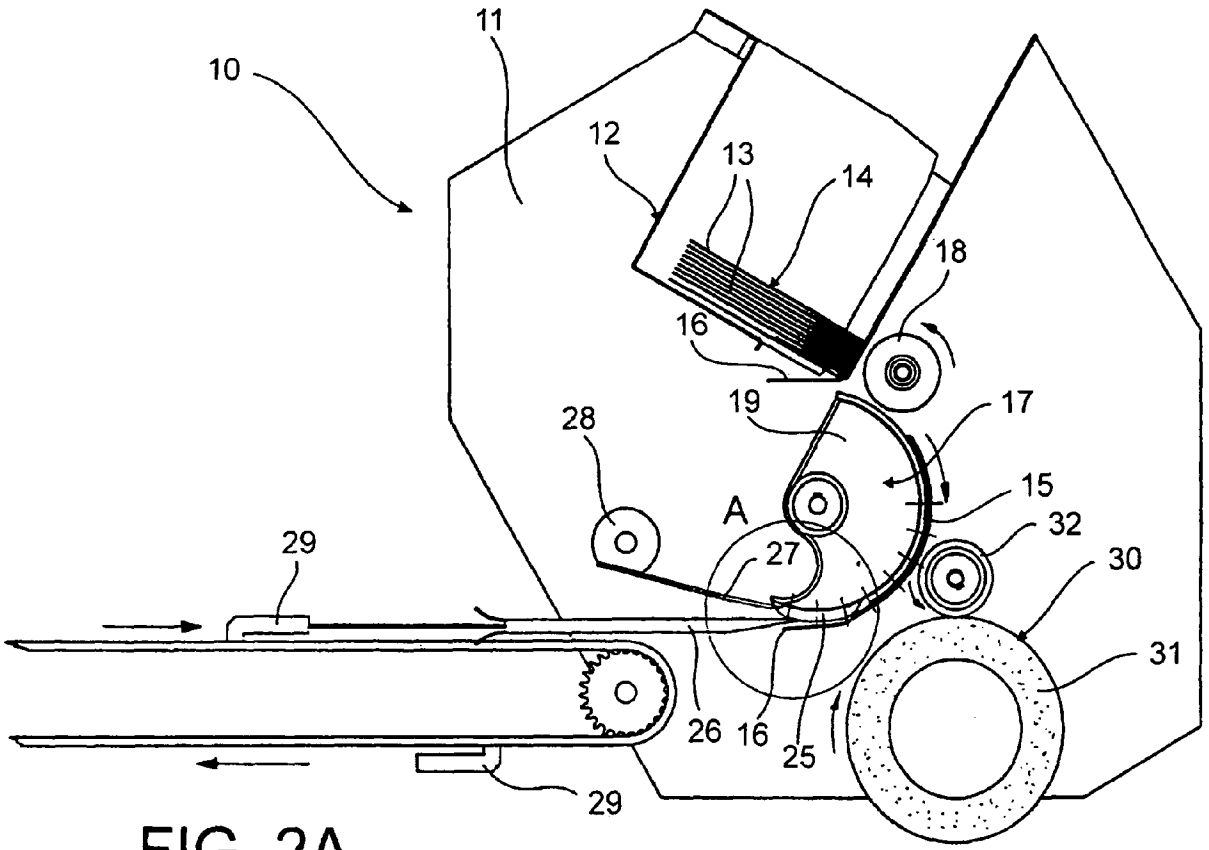
FIG. 2A is a side elevation view of the device according to FIG. 1A, in another established phase of its operation.
Figure 2B:
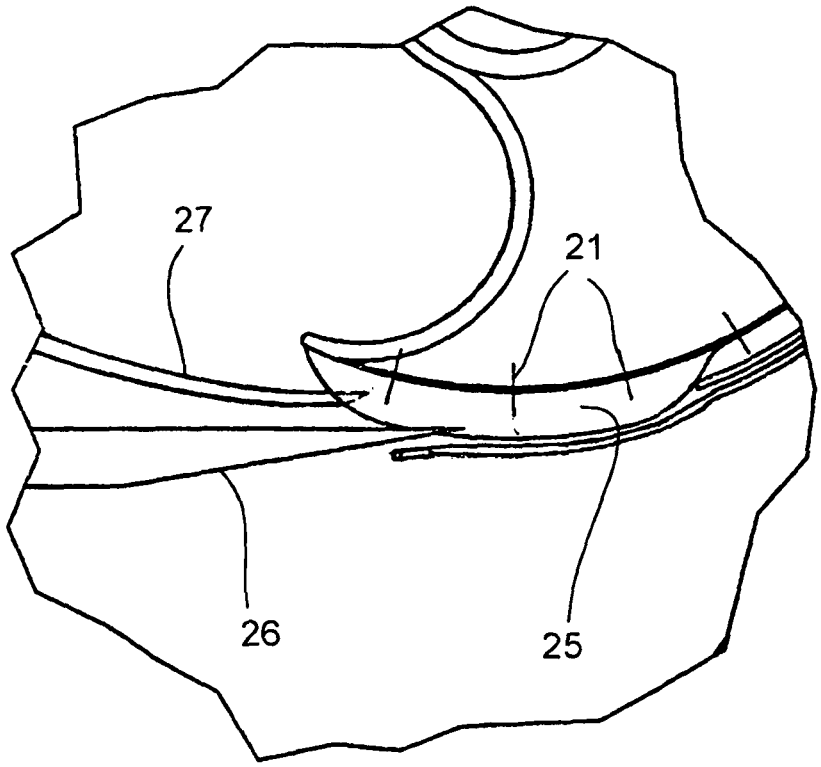
FIG. 2B is an enlarged partial view of part of the device in FIG. 2A.
Figure 3A:
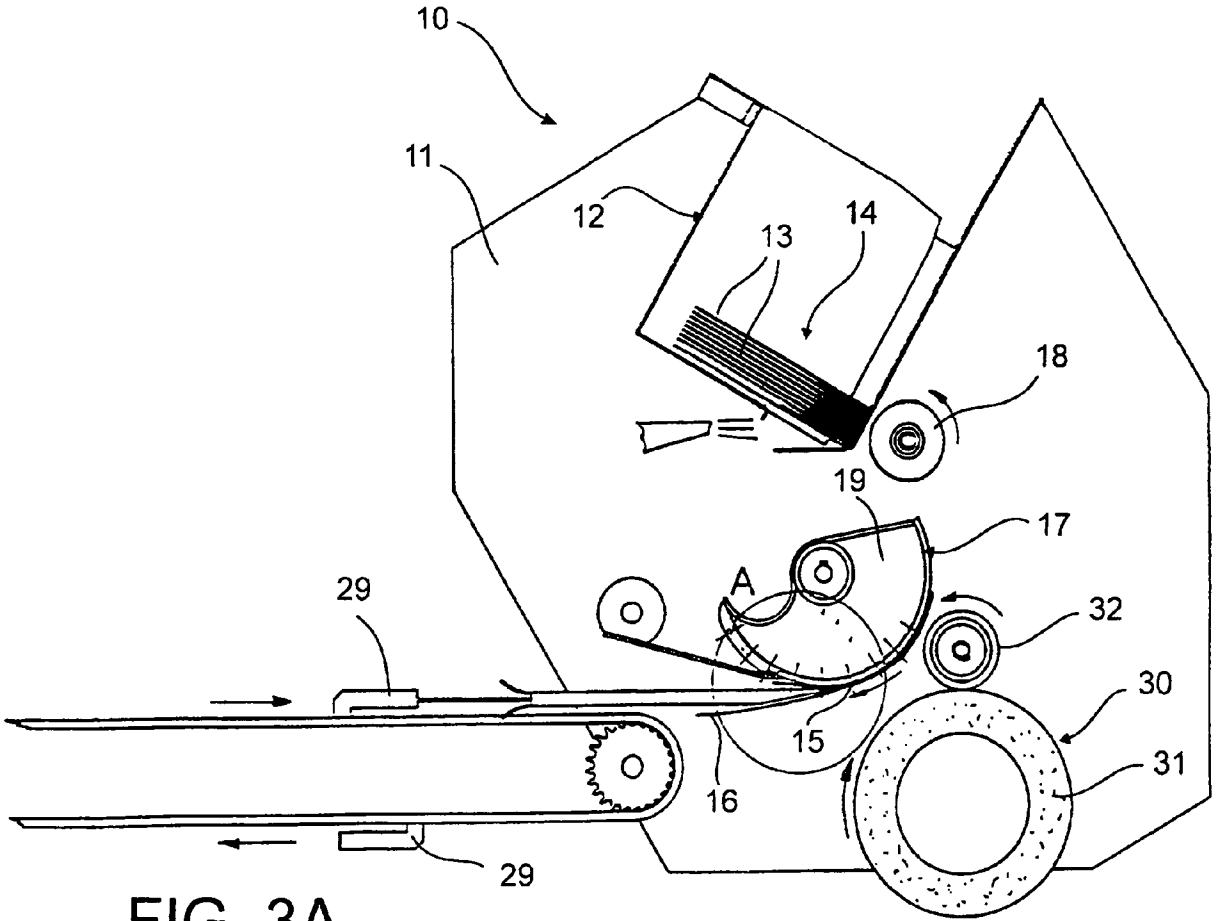
FIG. 3A is a side elevation view of the device according to FIG. 1A, in another established phase of its operation.
Figure 3B:
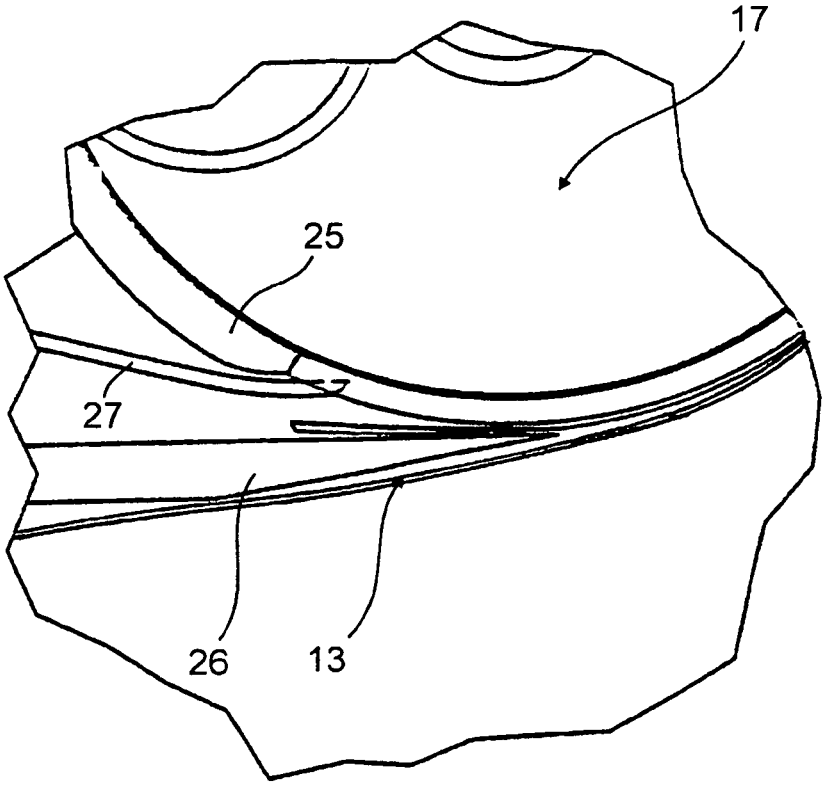
FIG. 3B is an enlarged partial view of a part of the device in FIG. 3A.
Figure 4A:
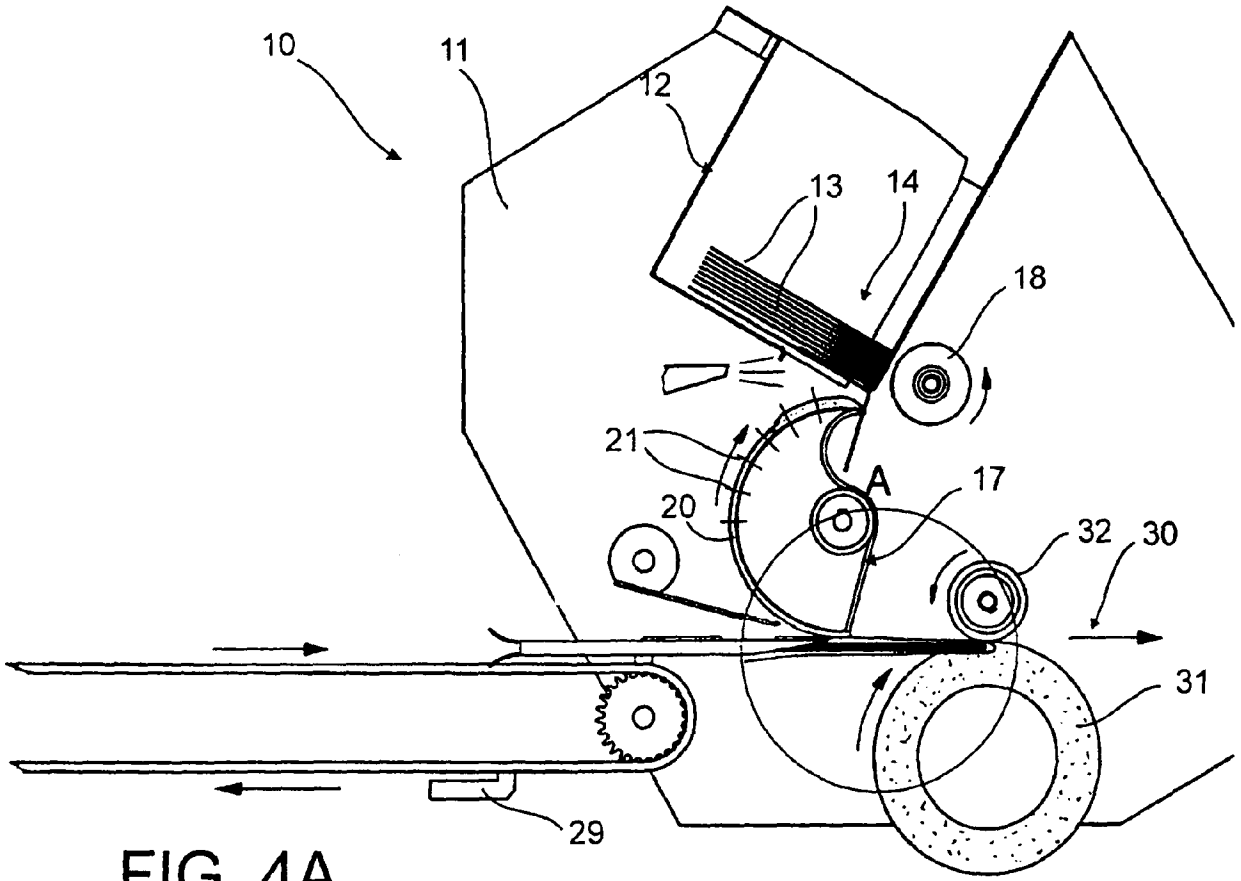
FIG. 4A is a further elevation view of the device according to FIG. 1A, in another established phase of its operation.
Figure 4B:
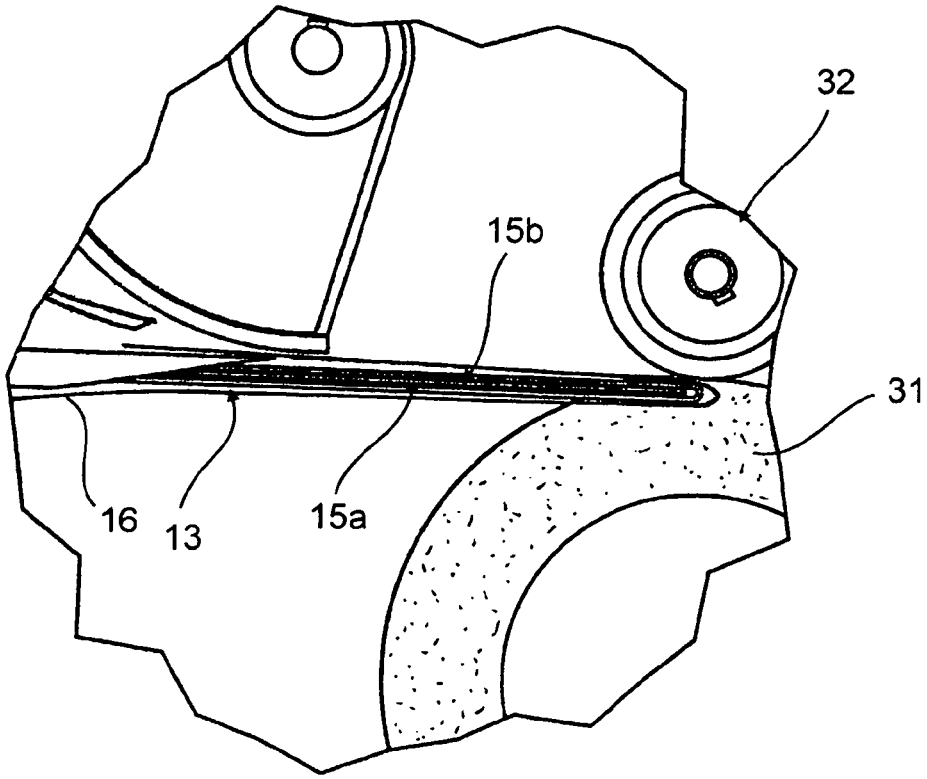
FIG. 4B is an enlarged partial view of a part of the device in FIG. 4A.

With reference to the Figures, the device 10 includes a frame 11, schematically represented by one or possibly two lateral support elements, on which is mounted a storage bin 12 for envelopes 13 stacked in the pile 14. These envelopes have a pocket 15 with a front wall 15*a*, provided with a window, a closing flap 16, and a back wall 15*b* on which the closing flap 16 is folded, without being glued, when the envelopes 13 are stacked, and glued after insertion of a letter or any other mail, and attached documents. The envelopes 13 are placed in such a way that the closing flap 16 is facing the bottom of the pile 14. The closing flap 16 of the envelope at the bottom of the pile is partially opened at the beginning of a stuffing cycle.

The device 10 also has an uptake and reversal rotary cam 17 and a support wheel 18 opposite to this cam. As is shown in FIG. 1A, the uptake and reversal rotary cam 17 has a peripheral surface 20 with a multitude of perforations 21 and includes a number of protuberant bands 22, made of a material with a high coefficient of friction. The uptake and reversal rotary cam 17 is closed, and defines an interior space 19 which interacts with the perforations 21 and a vacuum device (not represented), which is preferably coupled to this interior space by means of a hollow shaft 23 on which the cam is mounted. The uptake and reversal rotary cam 17 has a lip 24, which is designed to open the closing flap 16 and a support protuberance 25 with a radius greater than that of the peripheral surface 20. This protuberance 25 also has perforations 21 and acts as a support for the closing flap 16 of an envelope 13, while the peripheral surface 20 serves as a support for its back wall 15*b*.

The support wheel 18 co-operates with the uptake and reversal rotary cam 17 to grasp the envelope and ensure its extraction from the pile 14.

The device 10 also has a positioning guide 26 placed in the path of the envelopes 13 and designed to lift the closing flaps 16 of the envelopes, and to open their pocket 15. It also has at least one scraper 27 designed to detach the back walls 15*b* of the envelopes from the uptake and reversal rotary cam 17. The embodiment as described, which has two parallel scrapers 27 mounted on an axis 28 supported by the frame, comprise two blades slightly curved at their free extremities that are supported by the peripheral surface of the uptake and reversal rotary cam 17.

The device is moreover provided with a telescopic arm 29 having the form of a hollowed hook in his lower part, and which is designed to push the letters, the mail, and the attachments into the pockets 15 of the envelopes 13, and to further push these stuffed envelopes in the direction of the means of evacuation 30 illustrated schematically by a drive wheel 31 and a backup roller 32 which is supported by the drive wheel 31.

In the course of an operating cycle, the device 10 works in conformity with the process of the invention in which the envelopes are stacked so that the envelope closing flaps are located on the bottom of the envelope, and facing the front in an uptake direction. These closing flaps are unfolded toward the bottom by the 24 of the uptake and reversal rotary cam 17. These closing flaps are brought into contact with the protuberance 25, and the envelopes are extracted from the pile 14 and pressed by vacuum force against the peripheral surface 20 of the uptake and reversal rotary cam 17, and directed in a reversed position toward the area for receiving letters, mail or attachments, i.e. the so-called stuffing area (inserting area).

As a consequence, in order to carry out this series of operations, the elements comprising the device 10 operate in the following manner:

The uptake and reversal rotary cam 17 turns in a clockwise direction so that the lip 24 hooks the closing flap 16 of the bottom envelope of the pile 14 of envelopes 13.

The closing flap comes into contact with the protuberance 25, and the pocket 15 of the envelope comes into contact with the peripheral surface 20 of the uptake and reversal rotary cam 17 due to the vacuum force applied through the perforations 21.

The envelope 13 is returned to its path by the uptake and reversal rotary cam 17.

When the envelope 13 arrives at the stuffing zone, the guide 26 deflects the closing flap and engages with the pocket 15 and opens it.

The scrapers 27 detach the back wall 15*b* of the pocket 15.

The guide 26 keeps the envelope open so that it is ready to receive the letters and/or the mail on which are deposited the attachments.

The envelope is then engaged by the telescopic arm 29 and withdrawn from the device by the drive wheel 31 and the backup roller 32.

This device according to the invention thus enables the implementation of automatic stuffing at very high speed without risk to the envelopes and documents being handled.

The invention claimed is:

1. A method of inserting at least one object into envelopes from a stack of envelopes stacked in a stacker and having an envelope flap on the bottom face thereof, the method comprising the steps of:

opening an envelope flap of an envelope from the stack of envelopes by a rotary cam to facilitate insertion of the at least one object;

engaging the envelope flap of the envelope with a surface of the rotary cam and maintaining the envelope flap in contact with the surface of the rotary cam;

pulling the envelope, via the rotary cam, from the stack of envelopes via the envelope flap, into contact with an exterior surface of the rotary cam;

gripping the envelope with the surface of the rotary cam and maintaining the envelope in contact with the surface of the rotary cam;

conveying the envelope, by the rotary cam, to move the envelope into an inserting area;

detaching the envelope from the surface of the rotary cam; and inserting the object into the envelope and removing the envelope from the inserting area.

2. The method according to claim 1, wherein the envelope has a back wall, and the method further comprising the step of maintaining the envelope flap and the back wall of the envelope in contact with the surface of the rotary cam by a radial vacuum oriented toward the interior of the rotary cam.

3. The method according to claim 1, further comprising the step of detaching the envelope flap of the envelope from the rotary cam by a positioning guide.

4. The method according to claim 3, further comprising the step of opening the envelope by the positioning guide.

5. The method according to claim 1, wherein the envelope has a back wall, and the method further comprising the step of detaching the back wall of the envelope from the rotary cam by a tangential scraper.

6. The method according to claim 1, wherein the envelope flap of the envelope is opened by a lip of the rotary cam to open the envelope.

7. An apparatus for inserting objects into envelopes, the apparatus comprising:

a magazine for holding the envelopes in a stacker;

a rotary cam for opening and conveying the envelopes, wherein the rotary cam is adapted to open an envelope flap of an envelope with the rotary cam is adapted to maintain the envelope flap of the envelope in contact which a surface of the cam and to pull the envelope out of the stacker by the envelope flap, to maintain the envelope in contact with the surface of the rotary cam, and to move the envelope to an insertion area;

a feeder for feeding the objects to the envelops, and an inserter for inserting the objects into the envelopes.

8. The apparatus according to claim 7, comprising a positioning guide which is located on the path of the envelopes, the positioning guide being adapted to detach the envelope flap from the rotary cam and to open the envelope, and at least one scraper, positioned tangentially with respect to the surface of the rotary cam, and being adapted to detach a back wall of the envelope, and the positioning guide is designed to maintain the envelope in an open position.

9. The apparatus according to claim 7, further comprising a vacuum device, wherein the surface of the rotary cam comprises at least one peripheral surface perforated with openings, and the perforations being are connected to the vacuum device.

10. The apparatus according to claim 9, wherein the at least one peripheral surface perforated with openings has a protuberance to support the envelope flaps and a support area for the envelopes, and a radius of the protuberance is greater than the radius of the support area.

11. The apparatus according to claim 7, wherein the rotary cam comprises a lip adapted to grasp the envelope flap of the envelope.

12. A method of inserting at least one object into an envelope from a stack of envelopes stacked in a stacker and having an envelope flap on the bottom face, thereof, the method comprising the steps of:

rotating a lip of a rotary cam into contact with an envelope flap of a bottom most envelope in the stack of envelopes;

unfolding and opening the envelope flap, via the rotary cam, to facilitate insertion of at least one object into the envelope;

pulling, via the envelope flap, the envelope into contact with an exterior surface of the rotary cam;

maintaining the envelope flap in contact with the surface of the rotary cam, during further rotation of the rotary cam, to remove the bottom most envelope from the stack of envelopes and conveying the bottom most envelope to an inserting area;

detaching the envelope from the surface of the rotary cam;

inserting the at least one object into the envelope; and removing the envelope from the inserting area.

* * * * *